US005131733A

United States Patent [19]

Lautenschlager et al.

[11] Patent Number: 5,131,733

[45] Date of Patent: Jul. 21, 1992

[54] MOUNTING BRACKET FOR DRAWER GUIDES

[75] Inventors: Horst Lautenschlager, Reinheim; Horst Berger, Bielefeld, both of Fed. Rep. of Germany

[73] Assignee: Karl Lautenschläger GmbH & Co. KG, Reinheim, Fed. Rep. of Germany

[21] Appl. No.: 688,092

[22] Filed: Apr. 19, 1991

[30] Foreign Application Priority Data

Apr. 20, 1990 [DE] Fed. Rep. of Germany ..... 4012650

[51] Int. Cl.[5] ..... A47B 88/00

[52] U.S. Cl. ..... 312/334.38; 312/334.42

[58] Field of Search ..... 312/330.1, 344.1, 341.1, 312/336

[56] References Cited

U.S. PATENT DOCUMENTS 3,797,906 3/1974 Gutner ..... 312/330.1

4,501,453 2/1985 Gutner et al. ..... 312/330.1 X 4,810,045 3/1989 Lautenschlager ..... 312/341.1

*Primary Examiner*—Joseph Falk

[57] ABSTRACT

Mounting bracket (10) for the rearward end of the runner (18) of a drawer guide (20), in which the guide rail (22) to be fastened to the cabinet wall reaches from underneath into the corresponding runner (18) which is formed of a hollow structural shape open at the bottom and is to be fastened removably underneath the drawer bottom (16); a front mounting piece which can be mounted under the drawer bottom (16) in the area of the drawer front is associated with the front end of the runner (18), on which the outer end of the runner is releasably held.

The mounting bracket (10) to be fastened in the rear corner area of the drawer has two clip arms (36) projecting downward below the underside of the drawer bottom (16), at least one of which clasps the runner (18), and between which the runner can be passed.

3 Claims, 3 Drawing Sheets

MOUNTING BRACKET FOR DRAWER GUIDES

BACKGROUND OF THE INVENTION

The invention relates to a mounting bracket for the cabinet-interior end of the runner of drawer guides, in which the rail to be fastened to the wall of the cabinet engages the underside of the corresponding runner in the form of an inverted channel which is to be fastened removably to the drawer, and forms in the interior of the runner a track for rolling bodies which are held in an elongated cage and can roll on the track of the drawer guide rail and on a track formed by associated areas of the inside surface of the runner, and thus permit a longitudinal displacement of the runner relative to the rail, a front mounting piece which can be attached to the drawer bottom adjacent the drawer front being associated with the outside front end of the runner, in which the cabinet-exterior end of the runner is releasably held.

On account of the great number of rolling bodies in the form of balls and/or rollers separated from one another not only in the direction of drawer movement but also at right angles thereto, drawer guides of the kind here in question not only are easy-running and capable of bearing heavy loads, but also have the additional advantage that even in the fully extended state they have a high transverse stability, so that a drawer mounted on them in a cabinet will have no appreciable free play even in the fully extended state. Consequently, such drawer guides are increasingly used for mounting drawers in high-quality furniture. However, in comparison to rolling drawer guides which are more critical as regards their transverse stability in the extended state, the ball or roller bearing drawer guides described above are more complex and accordingly expensive to manufacture. If they are at all to be offered on a price-competitive basis they have to be made in large quantities. This means, however, that only certain, frequently used lengths of these drawer guides are available, while drawer guides of the kind here in question are not offered in precisely fitting lengths for drawers of a length differing from the standard dimensions. The plastic cage which holds the rolling bodies between the guide rail and the runner and spaces them apart limits the movement of the drawer guides to a length that is shorter than the length of the corresponding drawer, so that the back of the fully extended drawer is still inside of the cabinet by the length of the cage, i.e., drawer guides of the kind in question are so-called "short-length guides." Especially in the case of shallow drawers of very great length, the rear portion of the drawer that is still inside of the cabinet is difficult to see and reach into when the drawer is fully extended. It would therefore be desirable to make these drawer guides "full-length guides" in which the drawer can be drawn so far out of the cabinet that its back wall will be about flush with the front of the cabinet. Full-length drawer action is obtained in drawer guides of a different kind, such as the above-mentioned roller guides, by combining two single guides to make so-called "double guides." In the case of the drawer guides here in question the way to the creation of a full-length drawer guides is blocked by costs. On the other hand, however, in a number of cases, especially in the case of cabinets of great depth, such as kitchen floor cabinets, drawers are made in a length shorter than the depth of the cabinet, and then it often happens that no drawer guide of proper length is obtainable, while a longer drawer guide that would fit into the cabinet is available. The use of a longer drawer guide would even have the advantage that an additional length of drawer movement would be obtained, i.e., that the drawer could be drawn out entirely from the cabinet in the manner of a full-length drawer guide. The runner of a lengthened drawer guide then, of course, projects beyond the back of the drawer, raising the problem of attaching this protruding end to the drawer, since the runner must be removable and must be able to be fastened to the drawer so as to be easily and quickly unfastened therefrom. Mounting hardware is available (DE-OS 36 32 442) for fastening the front end of the runner adjacent the drawer front. Methods for attaching the protruding back end of the runners have also been developed in special cases, but they are limited to runners whose cabinet-interior end is fastened to the drawer in a certain manner.

These are runners in which an elongated tongue has been cut free at the rearward end from the web of the runner and then bent to form a hook by first bending the tongue at right angles away from the web and then bending a portion forward at right angles, i.e., to a position parallel to the web. When the runner is mounted on a drawer, this hook section parallel to the web is inserted into a corresponding bored in the back of the drawer. In the case of a runner overreaching the drawer in the area of its back, such mounting is evidently impossible, and it was for this reason that, in the above-mentioned previous solution (DE-OS 36 41 325), an adapter was placed on the protruding end of the runner, from whose front surface facing the drawer back a bolt projected which could be inserted into the bore serving to accommodate the horizontal hook portion of the above-mentioned mounting hook of the runner. In the rear face of the adapter, then a bore was provided into which the hook formed on the runner could be inserted. It is apparent that these adapters must be of a length precisely corresponding to the length by which the runner overreaches the drawer back. Since the amount of this overreach, however, is not established but depends on the length of the drawer, the adapters have to be made of a length to fit the special applications or cut afterward to the desired length.

The invention is addressed to the problem of creating a mounting bracket for the rearward end of drawer guide runners reaching beyond the back wall of drawers, which will be universally usable and completely independent of the length of the overreach of the runners.

THE INVENTION

This problem is solved in accordance with the invention in that the mounting bracket to be fastened in the rear corner of the drawer has two clip arms projecting downwardly below the bottom of the drawer, at least one of them clutching the runner, and the runner being able to be inserted between them. In its installation on a drawer the runner, therefore, can be slipped through the clip arms until its front end is held in an associated front mounting bracket. The length by which the rear end of the runner protrudes is inconsequential.

The inside surfaces of the clip arms facing the runner can best have an internal gripping surface substantially complementary to the external cross-sectional shape of the associated runner, i.e., they conform to the shape of the sides of the runner, and the clip arms hook over the edges of the runner forming the narrowed, slot-like opening of its channel. In the area of the mounting bracket the slot of the guide rail forming the tracks on which the rolling bodies run remains, of course, open.

The clip arms are preferably made so as to be resiliently flexible, the free space measured between their gripping surfaces being slightly smaller than the outside width of the runner. This assures that the clip arms will engage the installed runner with the desired resilient bias. On the other hand, the resilience of the clip arms permits removal of the drawer drawn out of the cabinet by releasing the front end of the runner at the drawer front from the holders there provided, and lifting the drawer upward so that the clip arms of the mounting bracket here under discussion will be resiliently spread apart so that they can be snapped off from the runner.

The clips of the bracket, in an advantageous further development of the invention are integral with a portion which can be fastened at the rear corner of a drawer, while the bracket is preferably made from a plastic that can be rendered resilient, although it can also be made from a plurality of parts joined together, and made even of other materials, such as metal, for example.

The bracket, for example, can be made with a mounting portion having a back which can be fastened flat against the back of the drawer. In the simplest case it can be fastened by screwing it to the drawer back, in which case holes are provided for the screws.

In special cases drawers have recently been made whose sides and/or backs are made from hollow metal structural shapes. In these drawers, separate corner-joint fittings are used for joining the sides to the back. Corner-joint fittings of this kind have also been developed for drawers and backs made of wood (DE-OS 37 04 218). In the case of drawers of this kind, provision is made in further development of the invention for the mounting bracket to be constituted by a corner-joint coupling joining together the cabinet-interior end of a drawer side and the associated end of the drawer back, i.e., the clips are simply provided at the bottom end of such a corner-joint coupling, and, if the corner-joint coupling is made of plastic, they can again be made integral with it by injection molding.

To facilitate mounting the drawer box on the runners riding on the guide rail it is recommendable to provide the gripping surfaces on the clips only on a portion of the width of the clips, next to ramp surfaces converging toward the cabinet interior such that the open cross section for accommodating the runner will diverge toward the cabinet-interior end of the clips.

SUMMARY OF THE DRAWINGS

The invention is further explained in the following description of embodiments in conjunction with the drawings, wherein.

DETAILED DESCRIPTION

Figure 1:
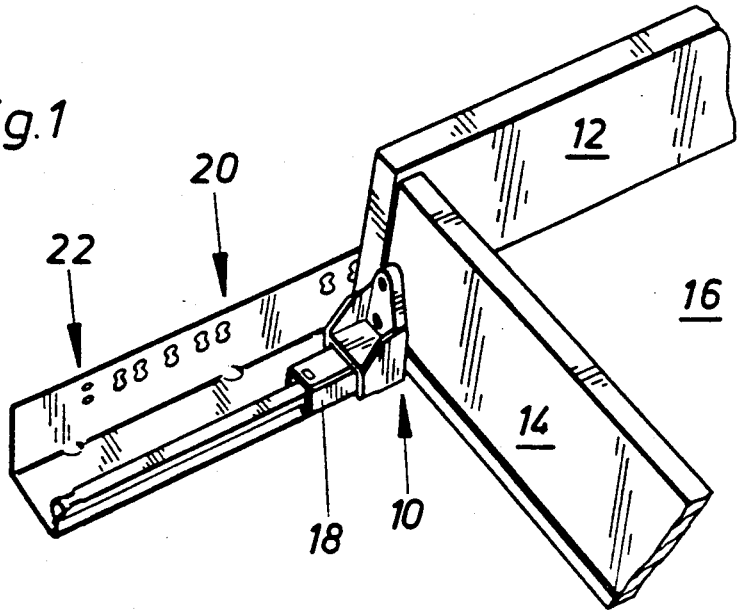
FIG. 1 is a perspective view seen by looking downward at an angle at the cabinet-interior rear corner area of a drawer and its corresponding drawer guide, whose runner is mounted on the drawer by means of a bracket constructed in the manner of the invention.
Figure 2:
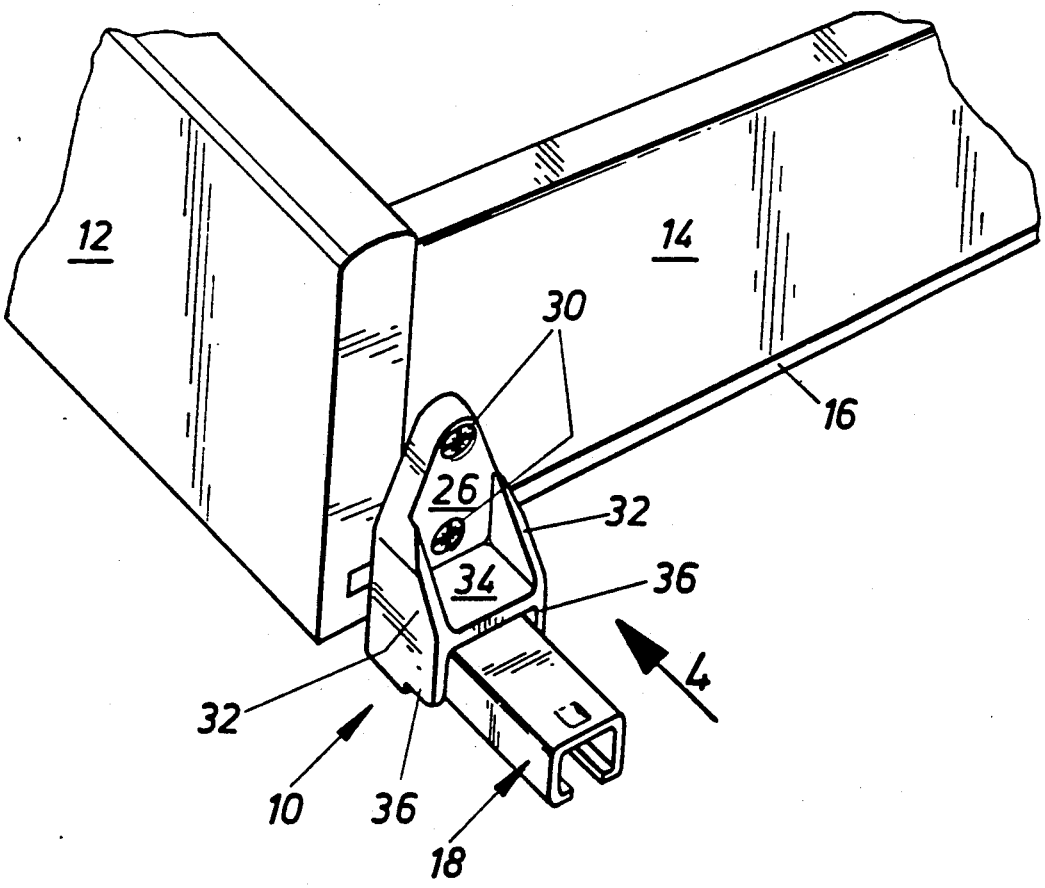
FIG. 2 is a perspective view of the corner area of the drawer shown in FIG. 1 as seen from a different viewing angle, wherein the rail of the drawer guide is omitted.
Figure 3:
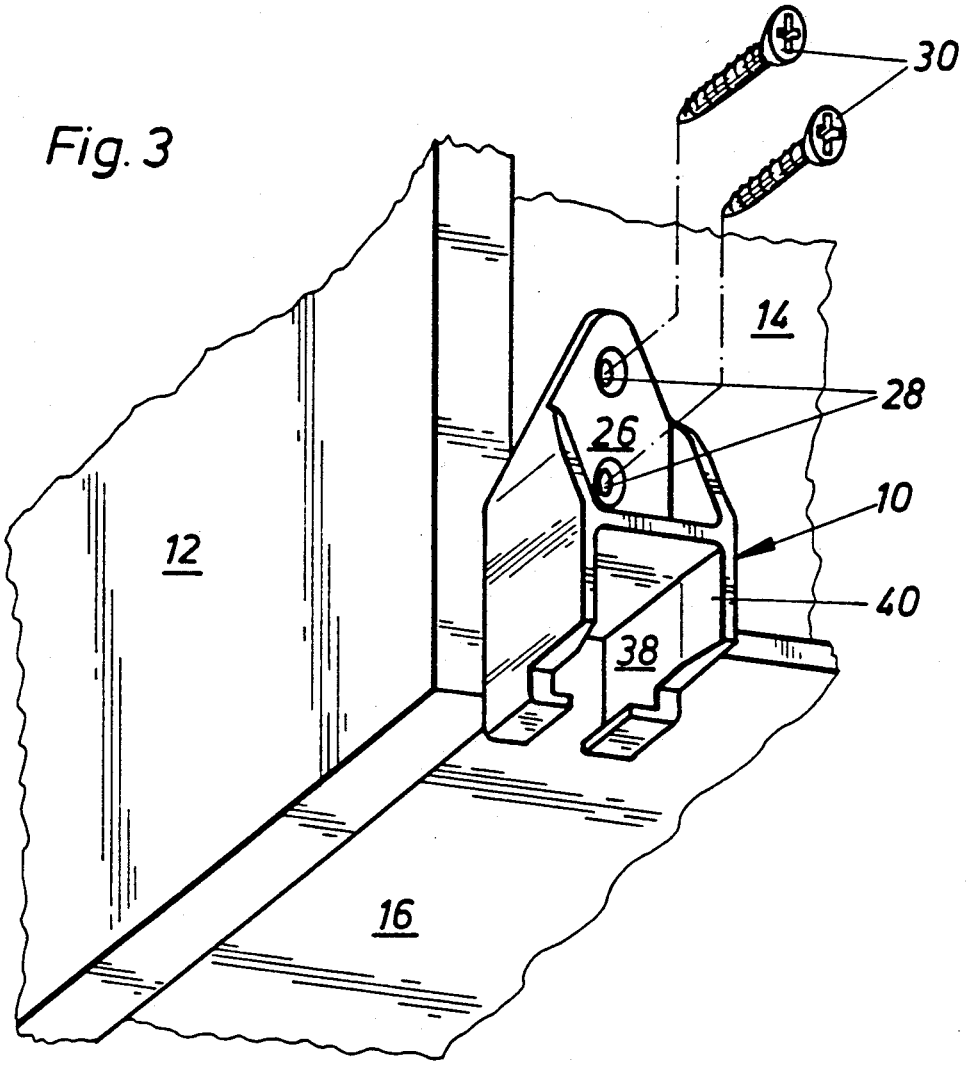
FIG. 3 is a perspective view seen by looking upward at an angle at the drawer corner area shown in FIG. 2, showing the mounting bracket, wherein, again, the rail of the drawer guide is omitted.

In FIGS. 1 to 3 is shown the arrangement of a first embodiment of the mounting bracket in accordance with the invention, designated in its entirety by the number 10, of which only the rear corner area is represented, namely the area in which the drawer side 12 meets the drawer back 14 and the drawer bottom 16. FIG. 1 shows how the runner 18 of a drawer guide is mounted in the mounting bracket 10 and shows the guide rail 22 of the drawer guide. In FIG. 2, only the end of the runner 18 is shown that is held in the mounting bracket 10 and projects beyond the drawer back 16 into the cabinet interior, while in FIG. 3 the drawer guide is entirely omitted.

Figure 4:
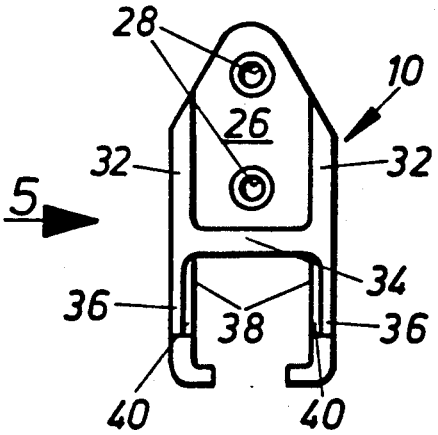
FIG. 4 is a front view of the mounting bracket according to the invention, as seen in the direction of arrow 4 in FIG. 2.
Figure 5:
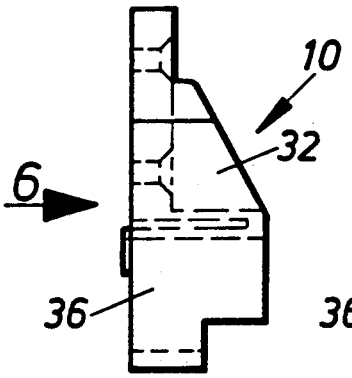
FIG. 5 is a side view of the mounting bracket as seen in the direction of arrow 5 in FIG. 4.
Figure 6:
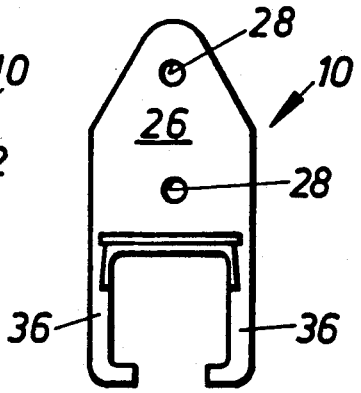
FIG. 6 is a rear view of the mounting bracket as seen in the direction of arrow 6 in FIG. 5.

The mounting bracket 10 itself is shown separately in FIGS. 4 to 6. From the drawings it can be seen that the mounting bracket 10 has in its upper part a portion 26 which can be placed flat against the drawer back 14 and has two countersunk bores 28 through which screws 30 (FIGS. 2 and 3) can be driven into the back 14 of the drawer. At the sides of the bracket, lateral reinforcing flanges 32 project along a lower portion of the height of the flat portion 26, and their width measured in the longitudinal direction of the runner increases downwardly. At the bottom end the lateral reinforcing flanges 32 are joined together by a transverse web 34. The lateral reinforcing flanges are prolonged downwardly beyond the transverse web 34 in the form of clip arms 36, these clip arms 36 being so shaped in cross section that the opening formed between them basically corresponds to the cross section of the runner 18, but they engage under resilient bias a runner 18 passing between them. Since the clip arms 36 curve toward one another at their bottom, free end portion, they hook beneath the runner 18, so that the latter is held fast under the bottom 16 of the drawer as regards the stresses normally occurring in the operation of the drawer, because, as a rule, means securing the runner 18 against displacements relative to the drawer in the longitudinal direction of the runner are provided in the area of the mounting bracket receiving the forward end, i.e., the drawer-front end of the runner, which is not under discussion here. The inner surfaces of the clip arms 36 in contact with the corresponding runner thus form gripping areas 38 which in their cabinet-interior end portion merge with entry areas 40 diverging toward the back wall of the cabinet, which facilitate the installation of a runner by insertion from the back between the clip arms 36. The mounting bracket 10 is made by injection molding from a thermoplastic that has been rendered resilient in the necessary manner.

Figure 7:
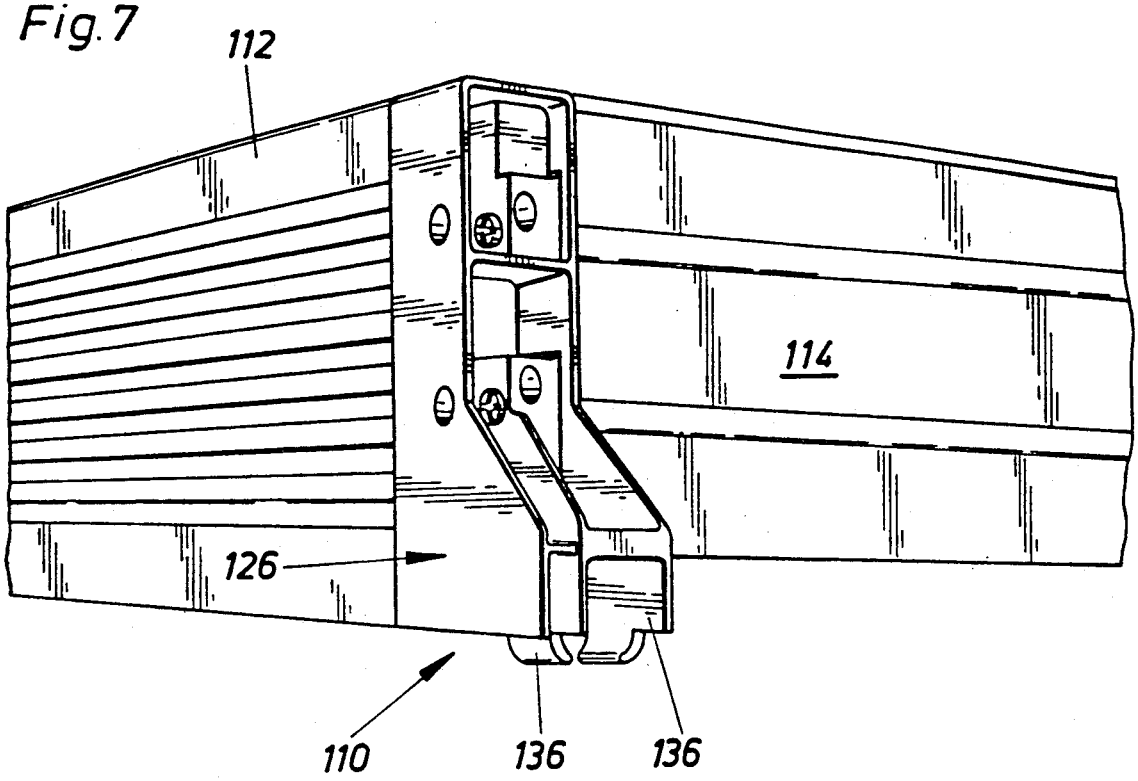
FIG. 7 is a perspective view of the rear corner area of a drawer whose back and sides are made of hollow metal structural shapes.
Figure 8:
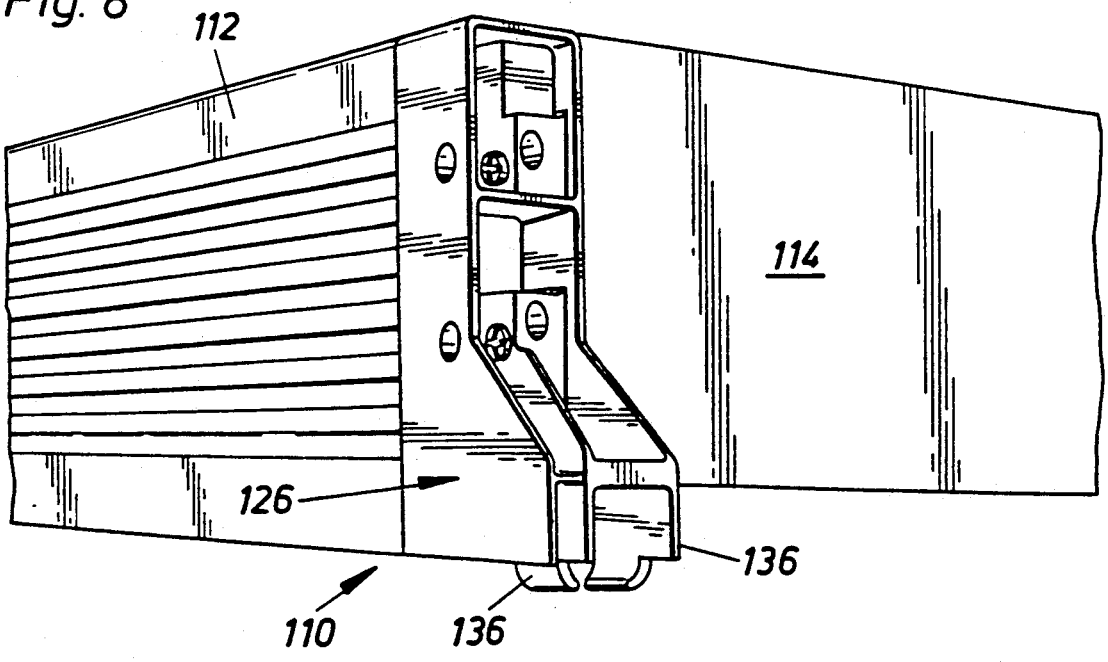
FIG. 8 is a perspective view corresponding to FIG. 7, of the rear corner area of a drawer having a side formed of a hollow metal structural shape and a wooden back.

In FIGS. 7 and 8 there is shown an embodiment of the mounting bracket 110 in which the clip arms 136 are part of a corner-joint coupling 126 which serves for joining a drawer side 112 made from a hollow metal structural shape to a drawer back 114 also made from a hollow metal structural shape (FIG. 7) or from wood (FIG. 8). Since corner-joint couplings for drawer walls are known in themselves and their configuration in regard to their function of joining drawer walls is not part of the present invention, there is no need to further describe them. It is important only that they bear integrally at their bottom end the clip arms 136, which are shaped and constructed like the clip arms 36 of the mounting bracket 10. In regard to the mounting of the runner the corner-joint coupling 126 therefore serves the function of portion 26 of the above-described mounting bracket 10.

In this case, too, the mounting bracket 110 can be an integral injection molding. Alternatively, it could be made from metal by the pressure-casting method, in which case the choice of the metal and the shape of the clip arms 136 must be such as to assure that they will be sufficiently resilient to straddle and hold onto the runner.

It is apparent that alterations and further developments of the embodiments described can be made within the scope of the idea of the invention. Such further developments can have to do, for example, with making the mounting bracket 10 or 110 not in one piece but assembling it from originally separate parts, in which case different materials can be used in portion 26 or corner-joint coupling 126 and in the clip arms 36 and 136, respectively. That is, the clip arms could be made, for example, from spring steel and joined to the rest of a mounting bracket made from plastic or pressure-cast metal.

I claim:

1. A mounting bracket for a cabinet-interior end of a runner of drawer guides, wherein a rail is adapted to be fastened to a wall of a cabinet, a corresponding runner having an underside into which said rail extends and which is formed by a hollow structural shape having an open bottom and which is removably fastened to the drawer, said runner having an interior in which is formed a track for rolling bodies which are mounted in an elongated cage and can roll on the track of the drawer guide rail and on a track formed of associated areas of an inside surface of the runner, thereby permitting a longitudinal displacement of the runner relative to the rail, a front mounting piece attachable to a bottom of the drawer adjacent a drawer front associated with an outside front end of the runner, in which said runner has a carcase-exterior end which is releasably held; comprising said mounting bracket (10; 110) being fastened in a rear corner area of the drawer and having two clip arms (36; 136) projecting downward past the underside of the drawer bottom (16), at least one of said clip arms reaching graspingly around the runner (18) and between which the runner (18) can be passed, said clip arms (36; 136) having inside surfaces facing the runner, each having an inner gripping surface (38) substantially conforming to an external cross-sectional shape of the associated runners (18), said clip arms (36; 136) being made resiliently spreadable, and that said gripping surfaces having a clear cross section measured therebetween that is slightly smaller than the external width of the corresponding runner (18), and a mounting portion adapted to be fastened in the rearward corner area of the drawer, and on which the clip arms (36; 136) are integrally formed, said mounting portion being formed by a corner-joint coupling (126) joining together the carcase-interior end of a drawer side (112) and the associated end of the drawer back (114) of the drawer.

2. A mounting bracket according to claim 1, wherein said mounting bracket is made from an elastically adjustable plastic.

3. A mounting bracket according to claim 1, wherein the gripping surfaces (38) provided on the clip arms (36; 136) extend in the runner's lengthwise direction over only a portion of the clip arms (36), and that lead-in surfaces (40) at an angle to the gripping surfaces (38) and sloping toward the carcase interior adjoin the latter such that the cross section for admitting the runner widens toward the carcase-interior end of the clip arms (36).

* * * * *